US006183275B1

(12) United States Patent
Okura et al.

(10) Patent No.: US 6,183,275 B1
(45) **Date of Patent: *Feb. 6, 2001**

(54) PANEL MOUNTED LEVER CONNECTOR

(75) Inventors: Yoshio Okura; Hikaru Ito, both of Yokkaichi (JP)

(73) Assignee: Sumitomo Wiring Systems, Ltd. (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/160,336

(22) Filed: Sep. 25, 1998

(30) Foreign Application Priority Data

Oct. 1, 1997 (JP) ..... 9-269008

(51) Int. Cl.[7] ..... H01R 13/62
(52) U.S. Cl. ..... 439/157; 439/271; 439/559
(58) Field of Search ..... 439/157, 559, 439/271, 159, 160

(56) References Cited

U.S. PATENT DOCUMENTS

| | | | | |
|---|---|---|---|---|
| 3,146,052 | | 8/1964 | Burch et al. | 439/350 |
| 3,292,133 | | 12/1966 | Burch et al. | 439/564 |
| 5,230,635 | | 7/1993 | Takenouchi et al. | 439/157 |
| 5,263,871 | | 11/1993 | Sano | 439/549 |
| 5,393,242 | * | 2/1995 | VanDerStuyf | 439/271 |
| 5,711,682 | * | 1/1998 | Maejima | 439/160 |
| 5,971,791 | * | 10/1999 | Itoh et al. | 439/559 |

FOREIGN PATENT DOCUMENTS

| | | | | |
|---|---|---|---|---|
| 4106-714 | * | 10/1991 | (DE) | 439/271 |
| 611 867 | | 1/1998 | (EP) . | |
| 5-87844 | | 11/1993 | (JP) . | |

* cited by examiner

*Primary Examiner*—Renee Luebke
*Assistant Examiner*—Briggitte Hammond
(74) *Attorney, Agent, or Firm*—Banner & Witcoff, Ltd.

(57) ABSTRACT

A panel mount connector comprising male and female connector housings (10,20) is shown in FIG. 3. A lever arm (30) pivotally connected to the male connector housing (10) co-operates with pins on the female connector housing (20) to draw the housings (10,20) together, in use. A snap fit projection (18) enables the male connector housing (10) to be fitted to an aperture (H) in a panel (P). Sealing members (16,27) prevent the ingress of moisture.

19 Claims, 11 Drawing Sheets

PANEL MOUNTED LEVER CONNECTOR

The present invention relates to a connector attached to a panel.

A connector attached to a door panel of an automobile is shown in the-Laid-Open Publication JP 5-87844. This has a configuration whereby a male connector housing is fitted to an attachment hole of the panel by inserting a hood member of the male connector housing into the attachment hole, the male connector housing being inserted into the hood member from the opposite end so as to clamp the panel between the male connector housing and the hood member. A sealing grommet covers an open end of the attachment hole on the female connector housing, this sealing grommet waterproofing the attachment hole when the two connector housings are fitted together.

The two connector housings are fitted together by means of a nut and bolt. That is, the nut is inserted into the male connector housing and the bolt, to which the grommet has been fitted in a waterproof state, is supported in the female connector housing. The bolt is threaded into the nut and tightened. Fitting resistance occurs when the two connector housings are correctly and reliably fitted together, the fitting resistance being strong particularly when multiple terminals are employed. As a result of this resistance, the connector housings are fitted together with certainty in the correct fitted state.

The tightening and loosening operation of the bolt is performed with a tool such as a torque wrench, this tool fitting together with the hexagonal head of the bolt. Consequently this operation cannot be performed if the tool is not at hand; furthermore, the operation of fitting the tool with the hexagonal head of the bolt becomes troublesome since one has to find a tool that conforms to the size of the hexagonal head of the bolt.

The present invention has been developed after taking the above problem into consideration, and aims to present a connector housing which can be fitted and released without the use of tools.

According to the present invention there is provided a panel mount connector for an aperture in a panel, the connector comprising male and female connector housings, one of said connector housings having a lever clamp which, in use, co-operates with projections of the other of the connector housings, one of the connector housings being further provided with a shoulder and a sealing member abutting the shoulder which, in use, provides a seal between the connector and the panel.

The invention provides a connector assembly which can be fitted together or released by operating the lever clamp by hand. The need for a bolt and the consequent use of a fitting tool such as a wrench is thus eliminated. One advantage of using a lever clamp is that the connector assembly can be fitted to an aperture in a confined space where it would be difficult to wield a wrench accurately.

In a preferred embodiment one of the connector housings is provided with an abutment for engagement with the panel, the other of the connector housings having the sealing member, and the abutment is aligned with the sealing member. With this arrangement, as the housings are drawn together, the plate is clamped between the abutment of one of the housings and the sealing member of the other of the housings. Water is thereby prevented from entering the space between the connector housings and the attachment hole.

The male connector housing preferably includes a snap fit projection which is engageable with an edge of the aperture to latch the housing thereto. In use the male connector housing can be loosely connected to the aperture is and is retained in place while the female connector housing is fitted thereto. In use the snap fit projection may disengage the edge of the aperture as the housings are drawn together, with the snap fit projection being received in a recess of the female connector housing.

Embodiments of the present invention will now be described with reference to the accompanying drawings in which.

Figure 1:
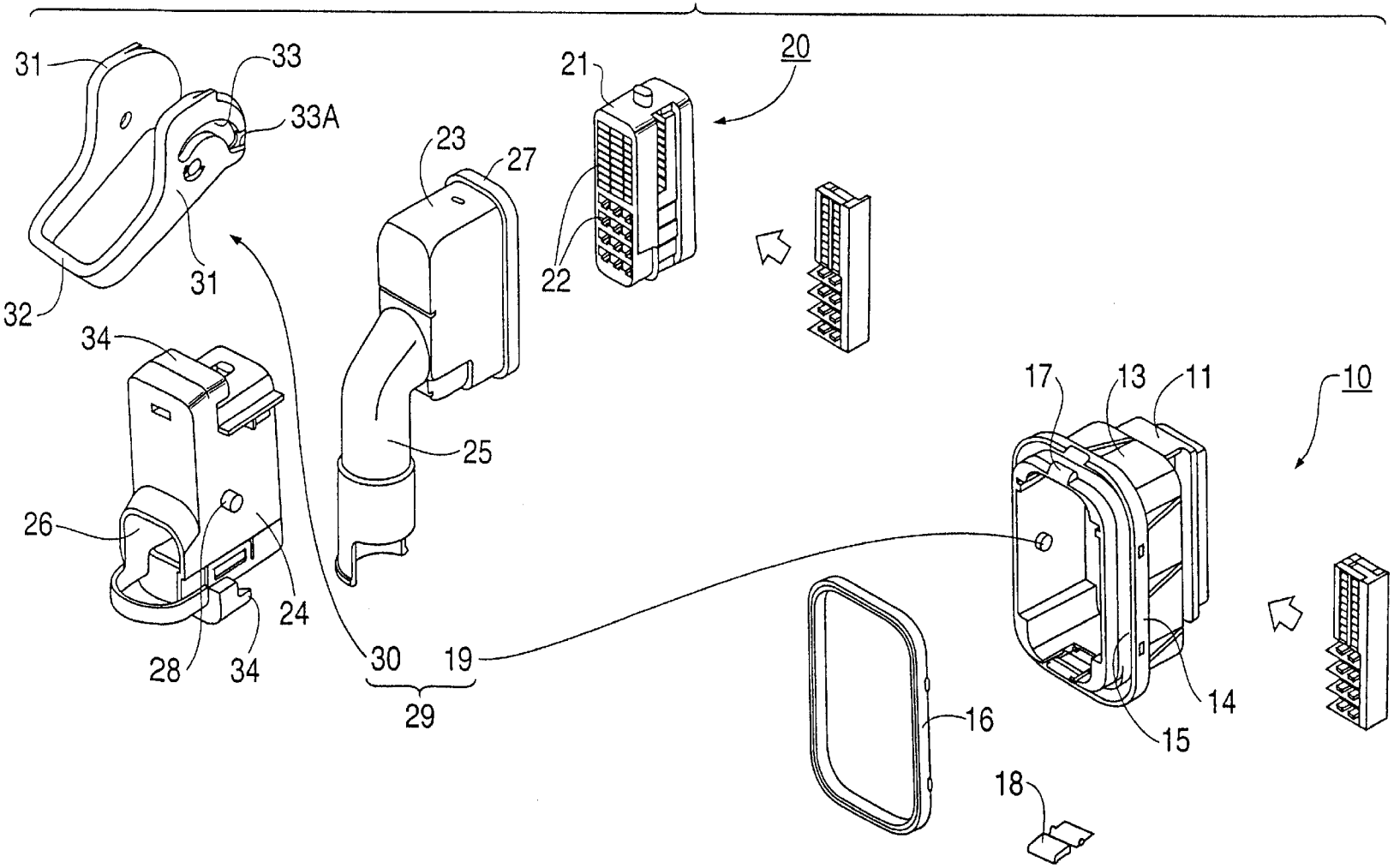
FIG. 1 shows a disassembled diagonal view of a first embodiment of the present invention.
Figure 2:
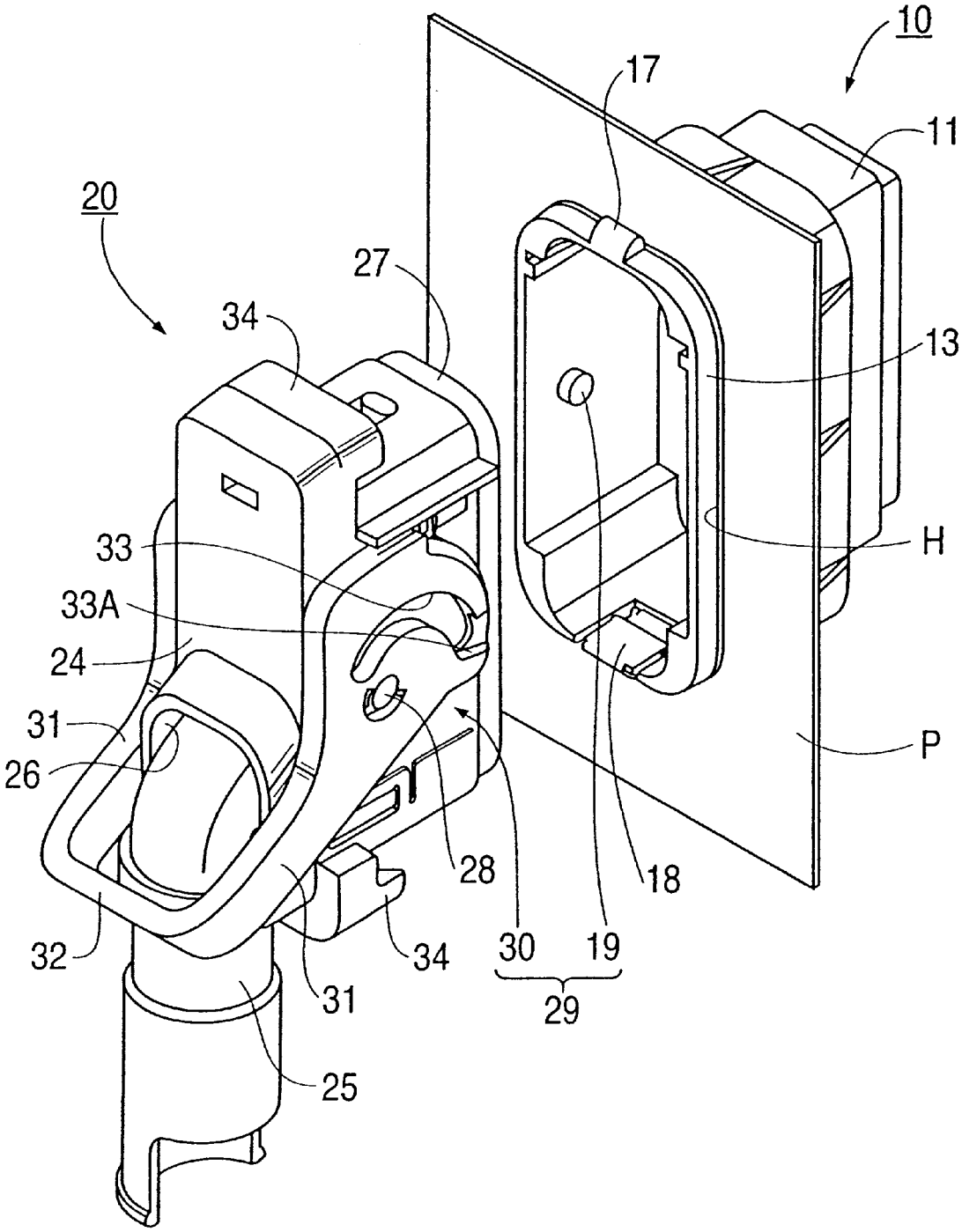
FIG. 2 shows a diagonal view showing male and female connector housings of the first embodiment in a separated state.

A first embodiment of the present invention is explained below with the aid of FIGS. 1 to 7.

A connector of this first embodiment comprises a male connector housing 10 and a female connector housing 20 which mutually fit together.

The male connector housing 10 comprises a plurality of male terminal fittings (not shown) housed within a cavity 12 of a housing main body 11. Tabs (not shown) of the male terminal fittings protrude into a hood member 13. A flange 14 is provided on the outer peripheral edge of the hood member 13. A sealing groove 15 extends along the entire circumference of the edge of the flange 14, and a ring-shaped attachment hole sealing member 16 (the attachment hole sealing means of the present invention) made from a resilient material such as rubber is provided in the sealing groove 15. The inner surface of the sealing groove 15 defines a shoulder 52 and a lip 53. In use, the male connector housing 10 is fitted tightly into an attachment hole H of a panel P from the anterior end of the hood member 13 (on the right in FIGS. 3 to 5). A stopping protrusion 17 formed on the upper edge of the hood member 13 and a stopping spring 18 attached to the lower end portion of the hood member 13 latch on edges of the attachment hole H to locate the male connector housing 10 with respect to the hole H. Consequently when the hood member 13 is latched in place the attachment hole sealing member 16 is positioned around the attachment hole H.

Figure 3:
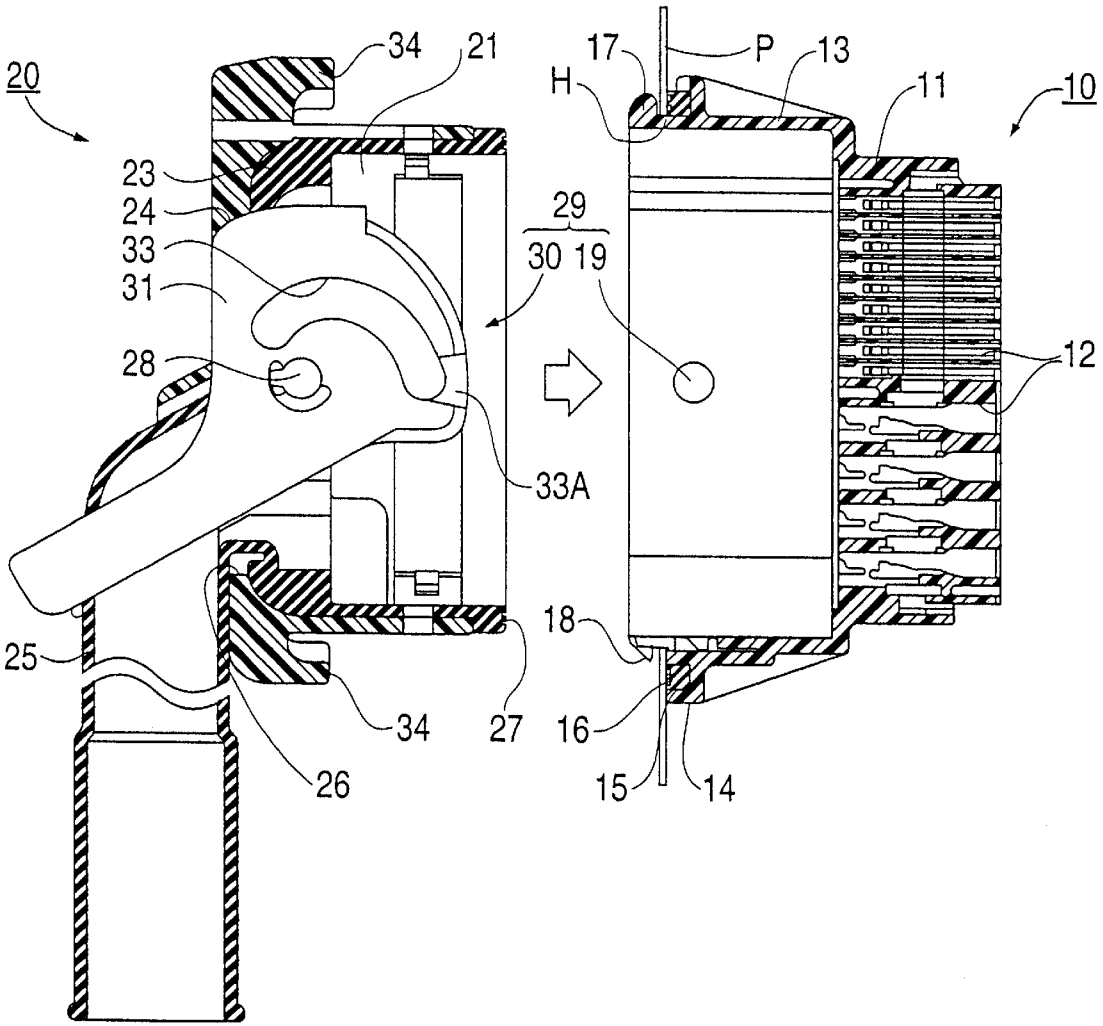
FIG. 3 shows a cross-sectional view of the male and female connector housings of FIG. 2.
Figure 4:
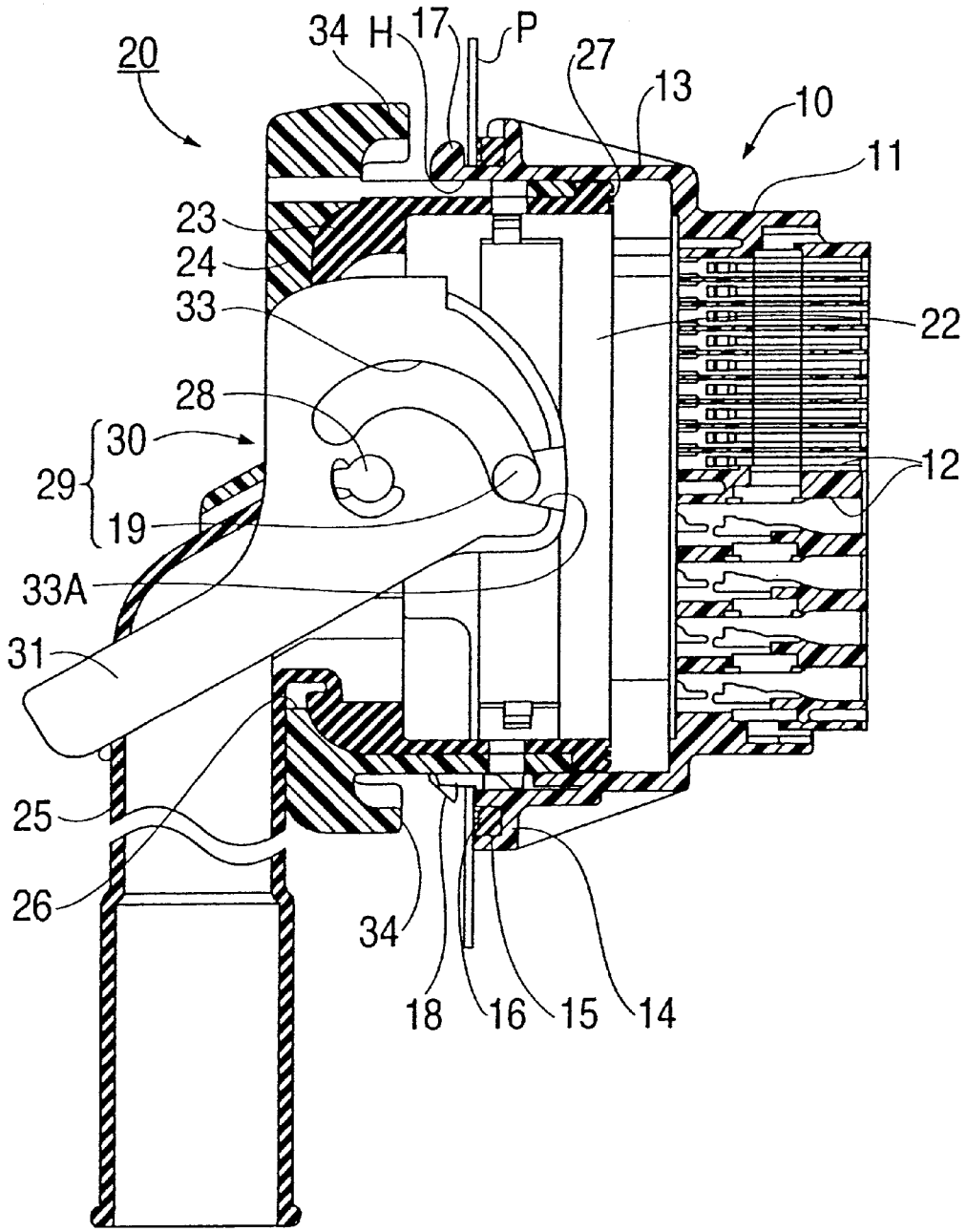
FIG. 4 shows a cross-sectional view of the male and female connector housings of FIG. 2 in the process of being fitted together.
Figure 5:
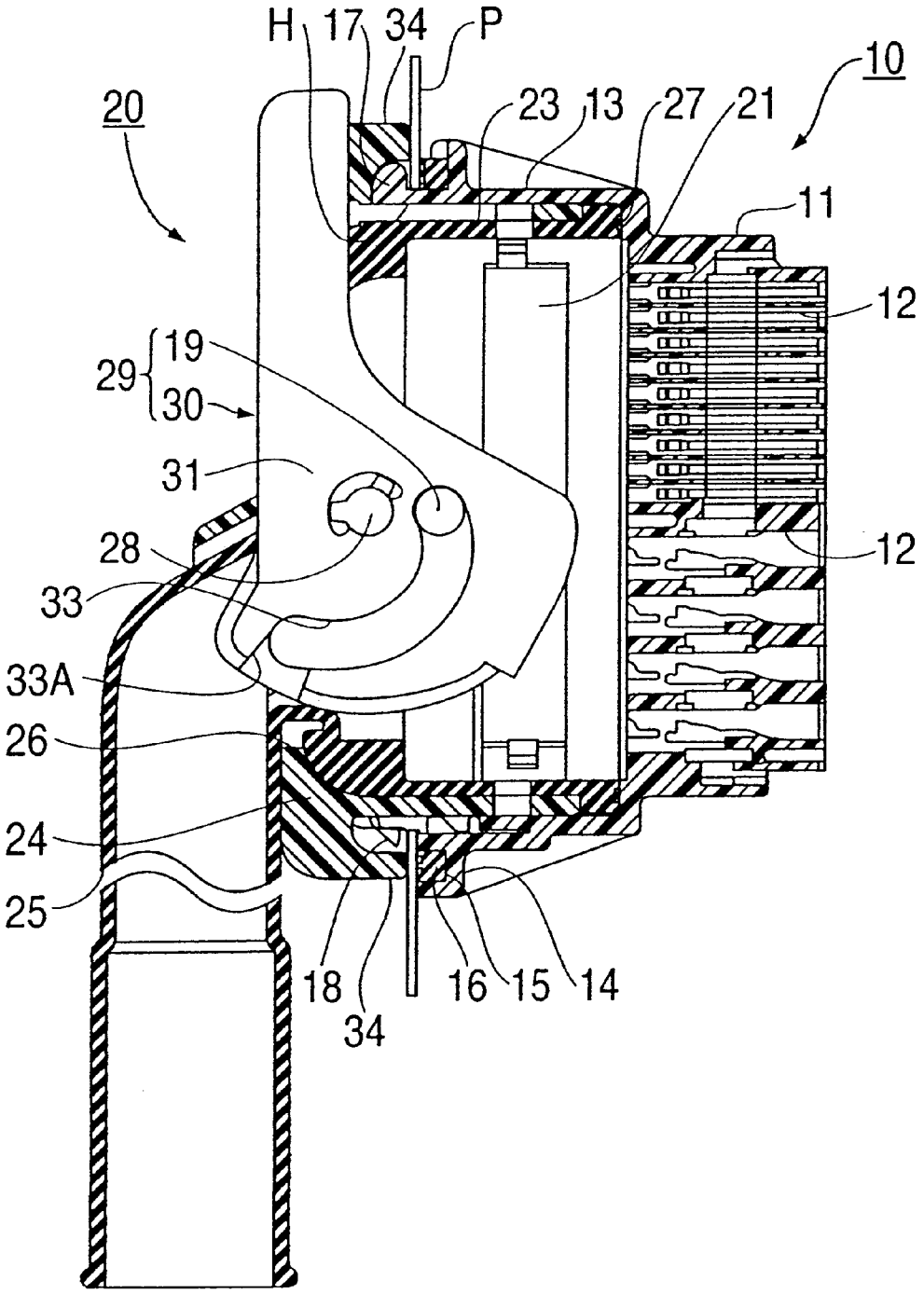
FIG. 5 shows a cross-sectional view of the male and female connector housings of FIG. 2 in a fitted state.

When the male connector housing 10 is in an attached state with the panel P, the hood member 13 extends along the open edge of the attachment hole H and is open in the leftward direction in FIGS. 3 to 5. The female connector housing 20 is brought into a correct fitted position (see FIG. 5) inside this hood member 13 by the operation of a lever 30. A pair of cam pins 19 are formed on opposite inner side faces of the hood member 13. The cam pins 19, together with the lever 30 (to be described later), comprise cam function means 29 of the present invention.

The female connector housing 20 comprises a housing main body 21 made from a plastics material such as resin. The housing 20 includes female terminal fittings (not shown) within cavities 22, a rubber grommet 23 which covers the housing main body 21 from its rear face (the face opposite the male connector housing 10) and the upper, lower, right and left sides of its outer peripheral face, and a grommet cover 24 made from hard plastics material, which entirely covers the grommet 23. A cylindrical electric wire conduit 25 protrudes from the rear face of the grommet 23, this electric wire conduit 25 passing through the grommet cover 24 via a through hole 26.

A fitting sealing member 27 is formed on the anterior end of the grommet 23, this fitting sealing member 27 having the ring shape of the external peripheral edge of the anterior face of the housing main body 21. The fitting sealing member 27 protrudes slightly from the anterior face of the housing main body 21 so as to surround and cover the openings of the cavities located on the anterior face. When the connector housings 10 and 20 are in a correctly fitted state, the fitting sealing member 27 fits tightly and in a waterproof manner with the far end face of the hood member 13.

A pair of supporting axles 28 protrude from the right and left external side faces of the grommet cover 24, which axles 28 support the lever 30, in use. The lever 30 has a pair of arm members 31 which fit with the supporting axles 28, the outer ends of the arm members 31 joining together to form an operating member 32. The lever 30 is capable of being rotated between a fitting starting position in which it straddles the housing main body 21, as shown in FIGS. 3 and 4, and a fitting completion position shown in FIG. 5, and is also capable of being inserted into the hood member 13 together with the housing main body 21. Spiral shaped cam grooves 33 are formed on the arm members 31 with the supporting axles 28 serving as their centre, receiving holes 33A being formed on the base end portions of the cam grooves 33 to receive the cam pins 19 when the lever 30 is in the fitting starting position.

A pair of receiving members 34 are formed on the upper and lower portions of the grommet cover 24, these protruding in an overhanging shape towards the male connector housing 10. When the connector housings 10 and 20 are in a correctly fitted state, these receiving members 34 make contact with a location slightly above the upper edge of the hood member 13 on the panel P and a location slightly below the lower edge of the hood member 13. Moreover, when the connector housings 10 and 20 are in a correctly fitted state, the receiving members 34 and the attachment hole sealing member 16 approach one another so as to clamp the plate P therebetween.

Figure 6:
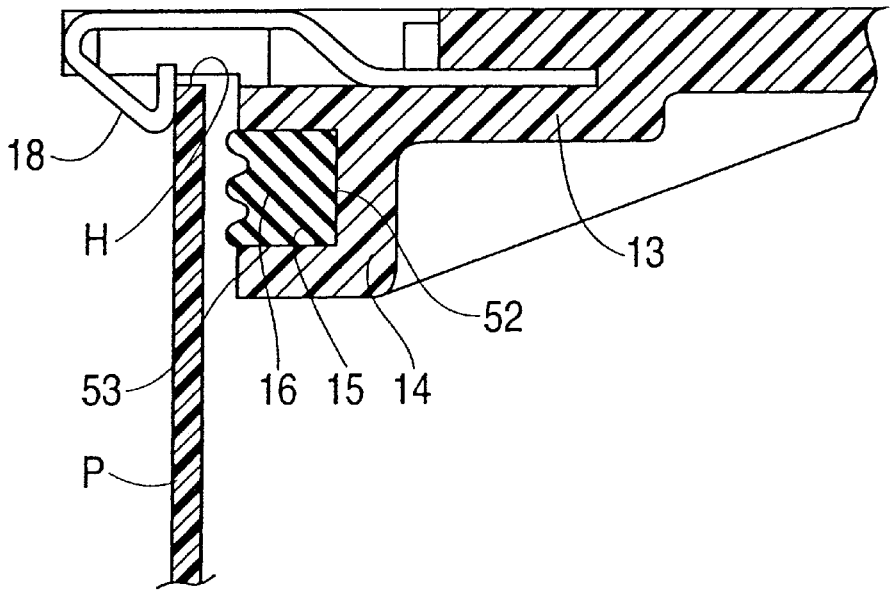
FIG. 6 shows a partially enlarged cross-sectional view of an attachment hole sealing member when the female connector housing of FIG. 2 is not yet fitted.
Figure 7:
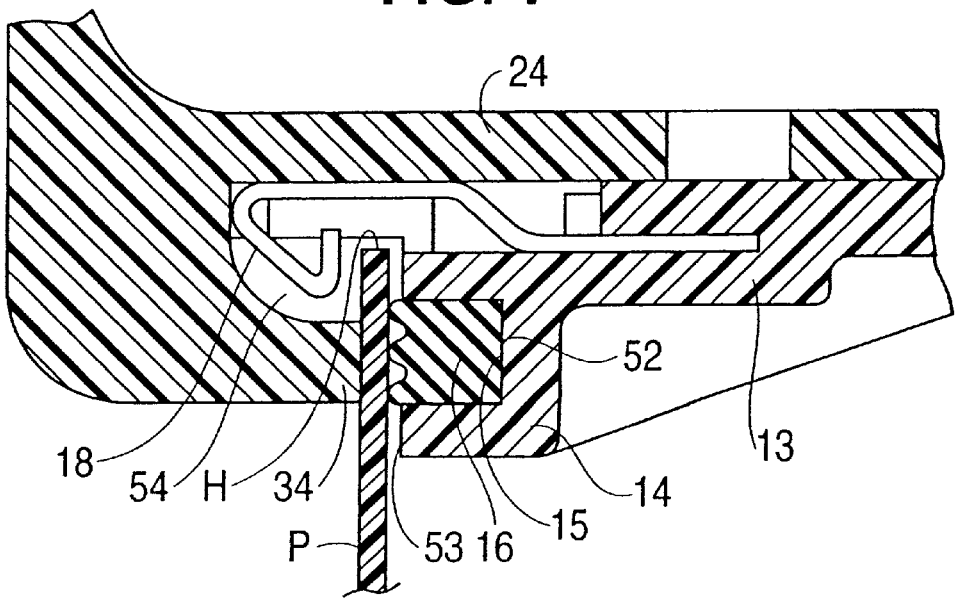
FIG. 7 shows a partially enlarged cross-sectional view of the attachment hole sealing member when the male and female connector housings of FIG. 2 have been fitted together.
Figure 8:
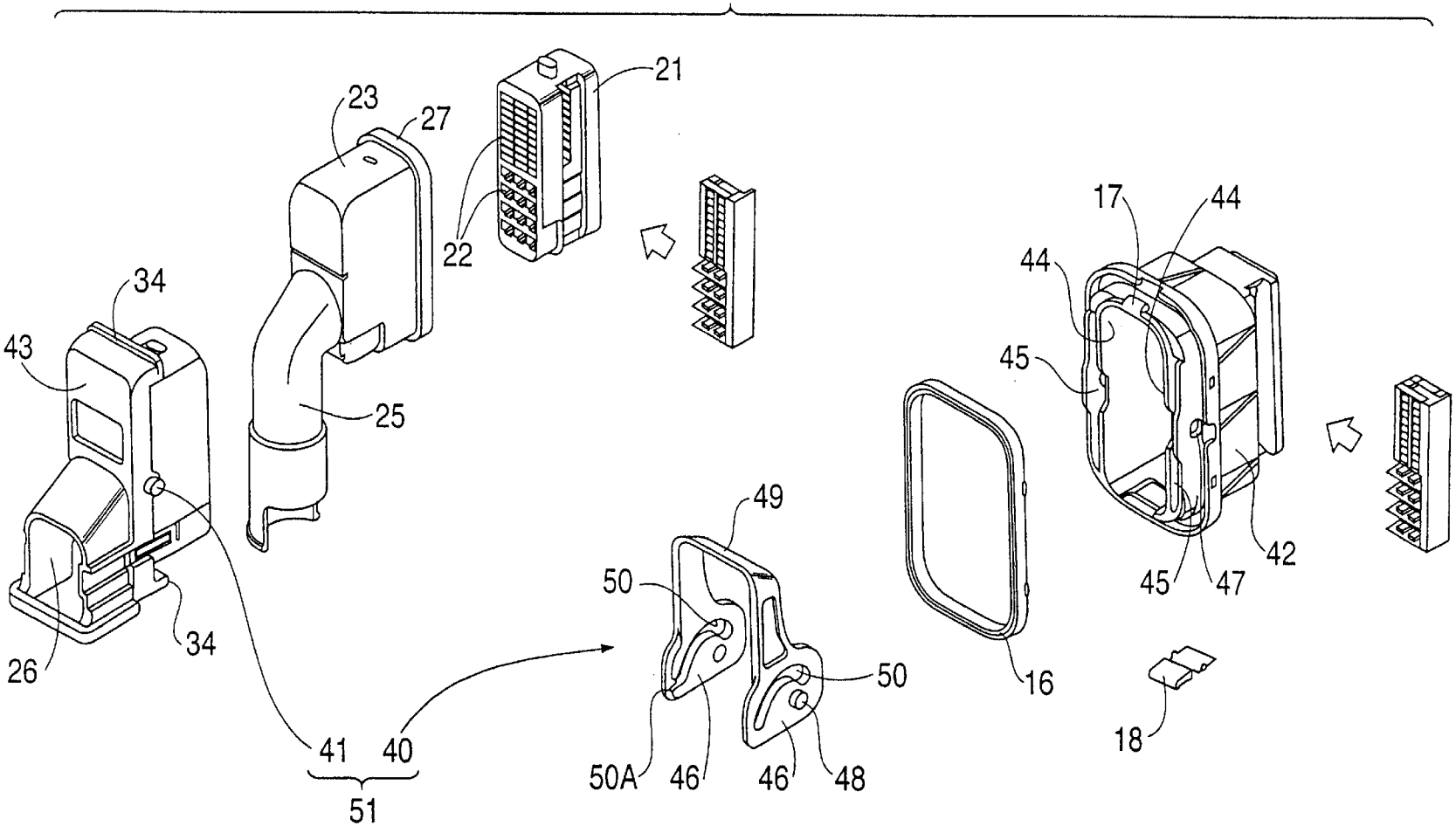
FIG. 8 shows a disassembled diagonal view of a second embodiment of the present invention.
Figure 9:
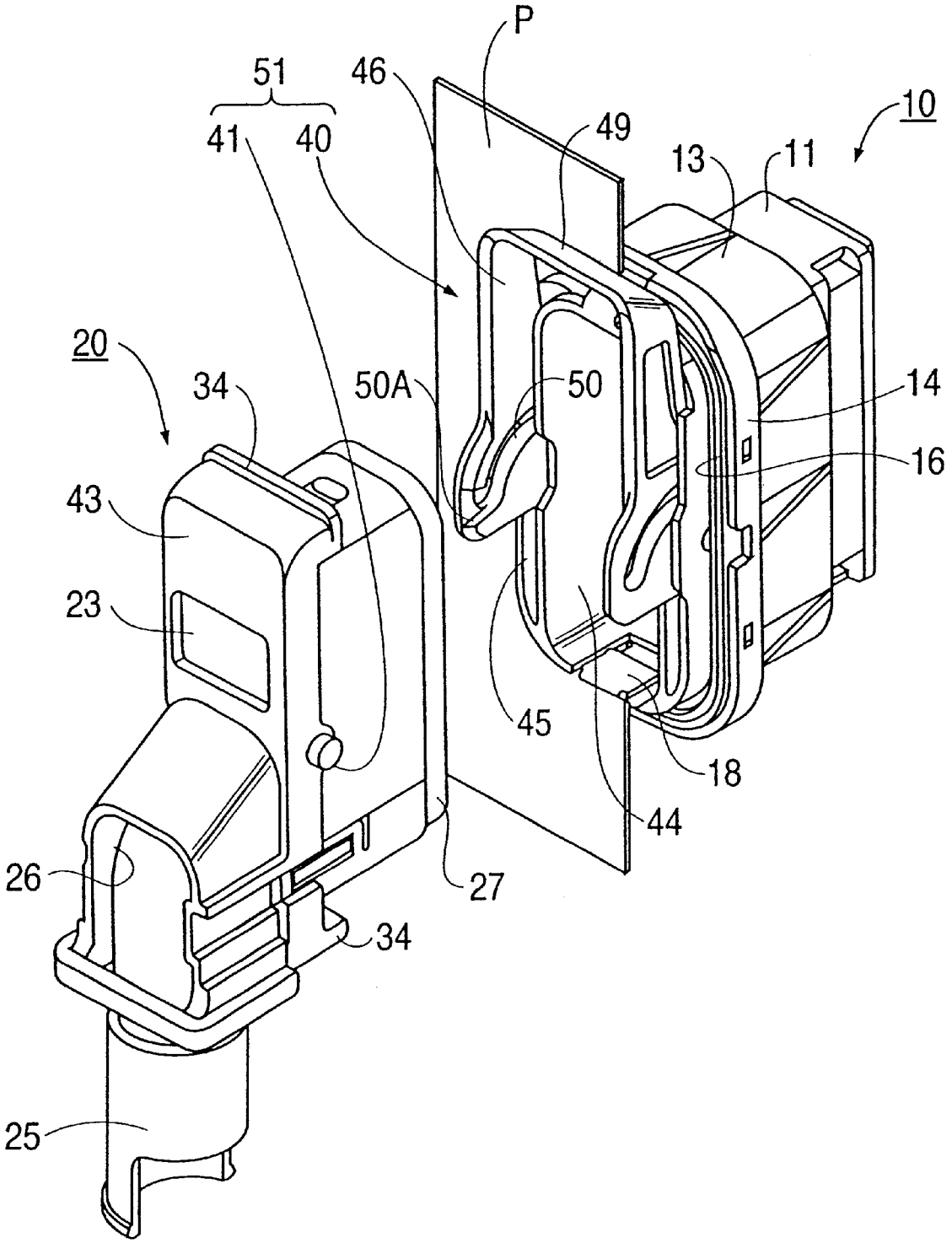
FIG. 9 shows a diagonal view of male and female connector housings according to the second embodiment in a separated state.
Figure 10:
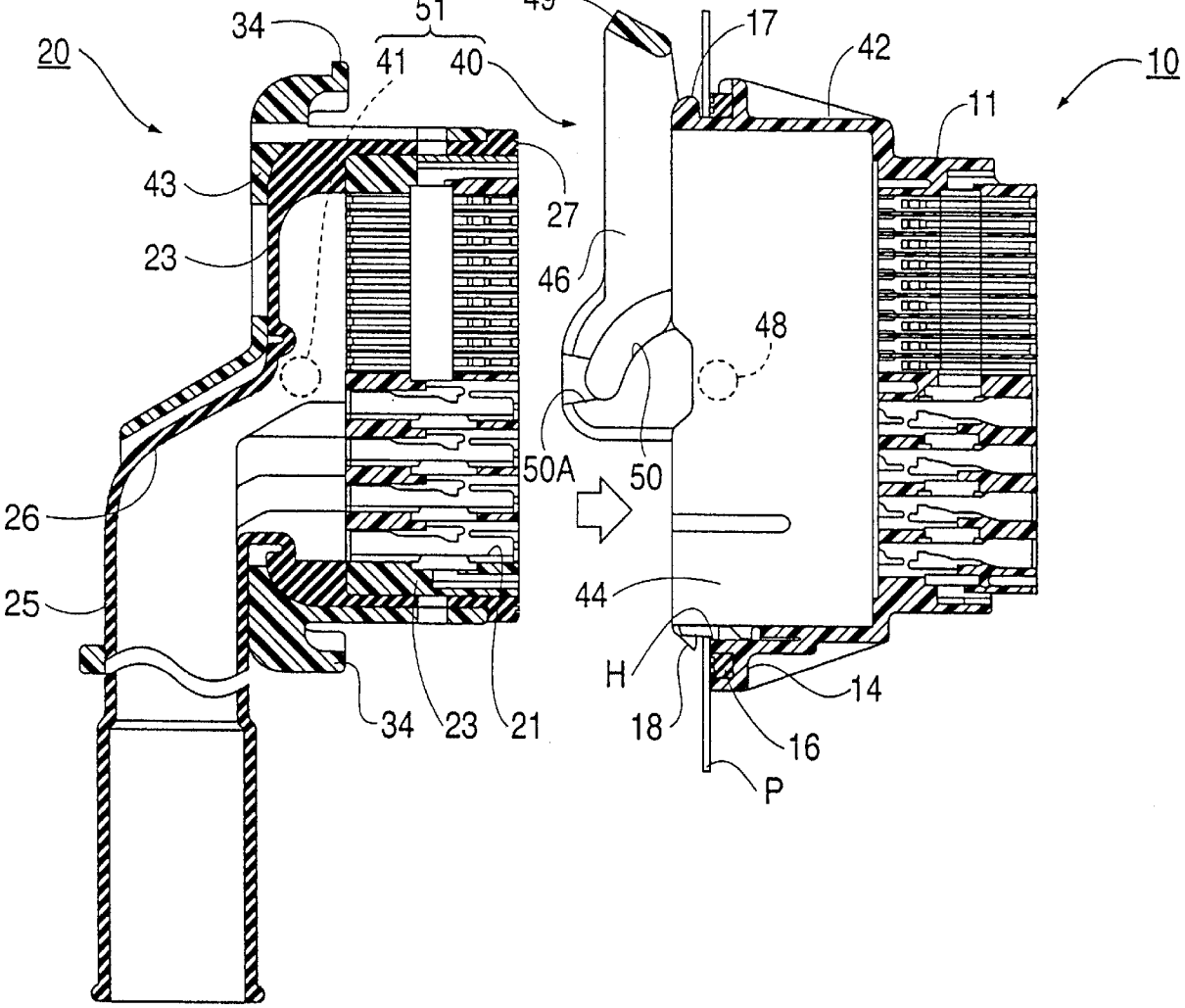
FIG. 10 shows a cross-sectional view of the male and female connector housings of FIG. 9 in the separated state.
Figure 11:
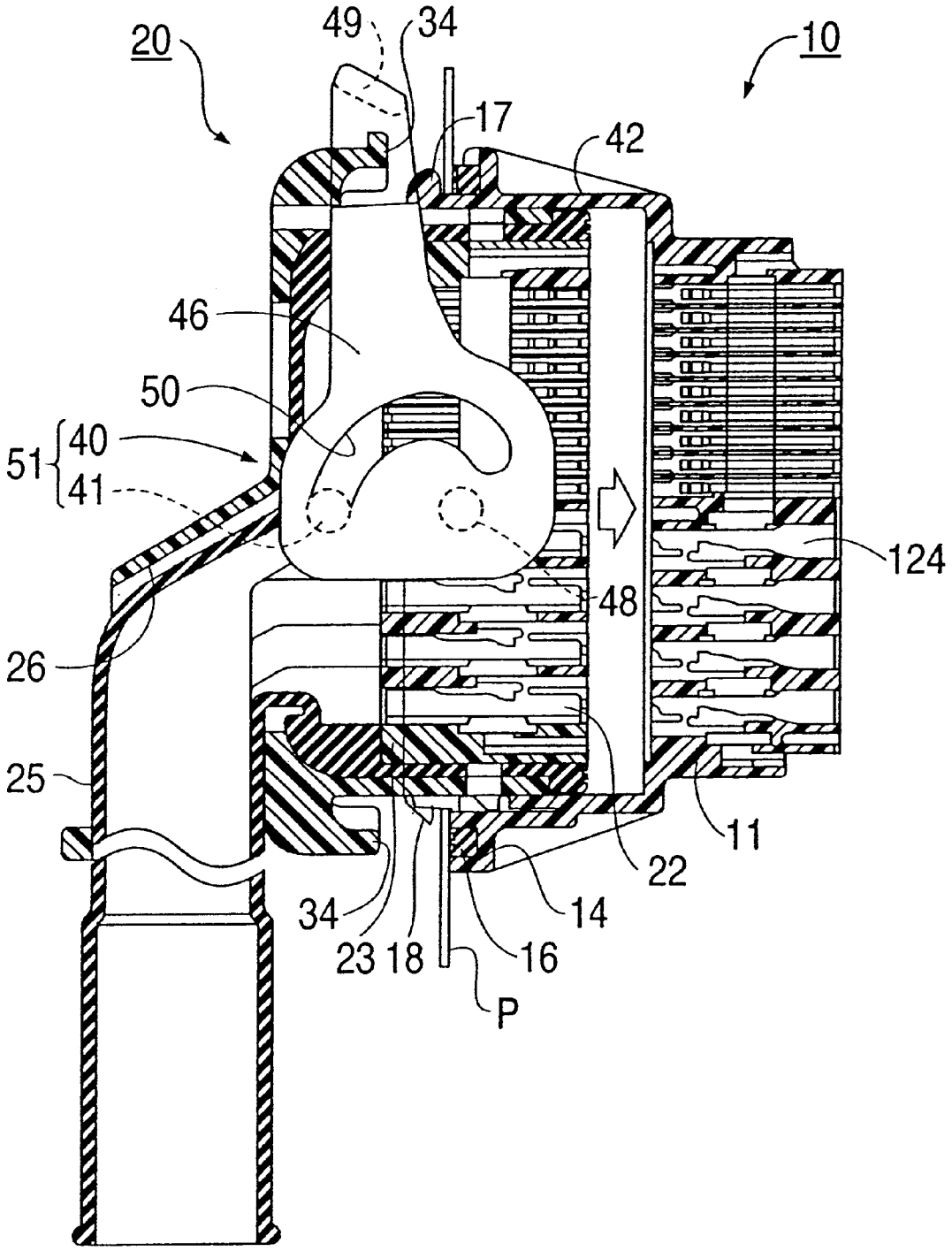
FIG. 11 shows a cross-sectional view of the male and female connector housings of FIG. 9 in the process of being fitted together.
Figure 12:
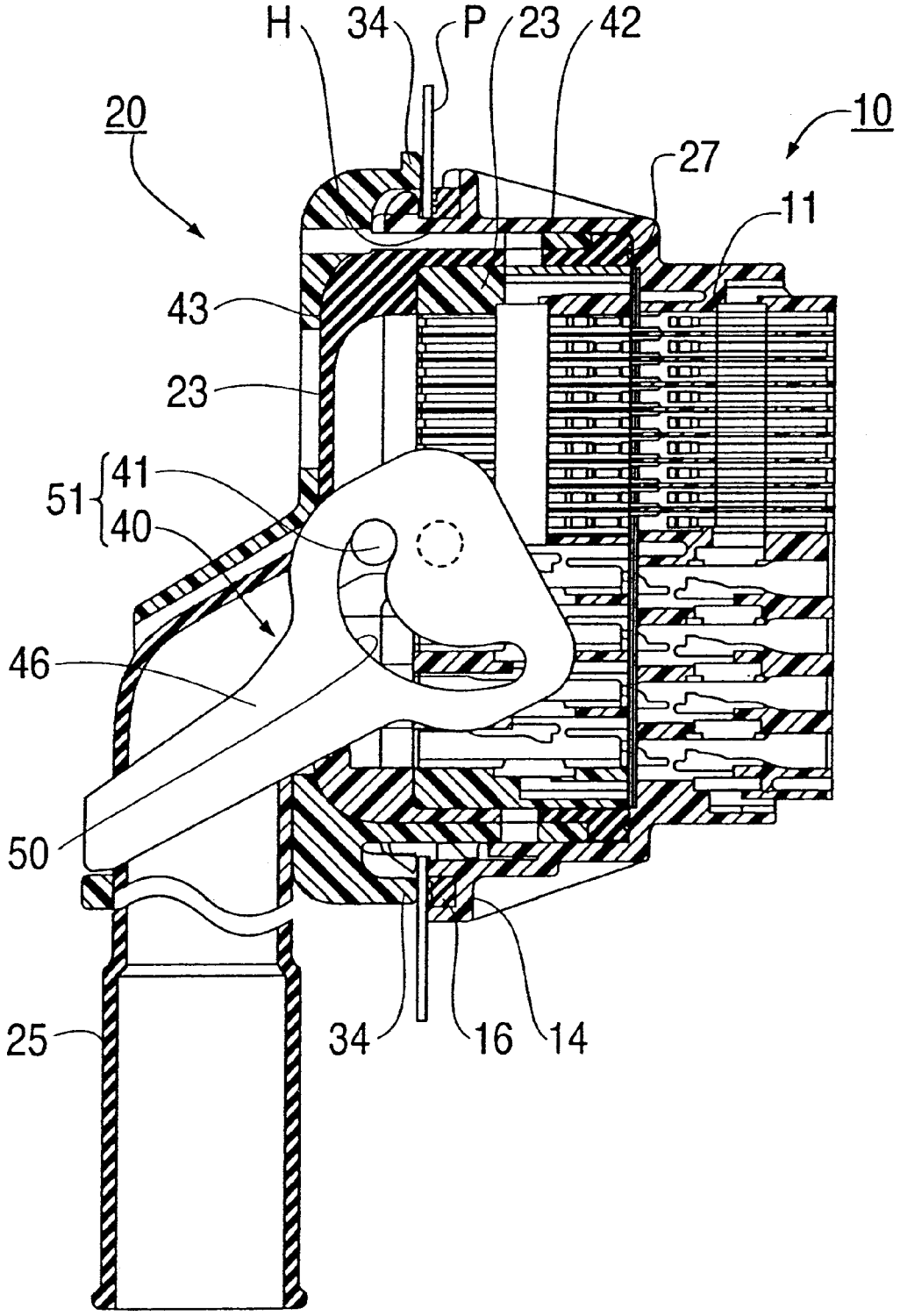
FIG. 12 shows a cross-sectional view of the male and female connector housings of FIG. 9 in a fitted state.

FIGS. 6 and 7 show the interaction between the stopping spring 18 and the plate P. FIG. 6 shows the male connector housing 10 fitted to the attachment hole H. The housing 10 is retained in the hole H by stopping spring 18 latching against an edge of the hole. In use, when the male and female connector housings 10,20 are drawn together, the stopping spring moves out of engagement with the plate P, as shown in FIG. 7. In the embodiment shown in FIG. 7 the stopping spring is received in a recess 54 of the female connector housing 20.

Next, the operation of the present embodiment is explained.

When the connector housings 10 and 20 are to be fitted together, the male connector housing 10 is first attached to the attachment hole H of the panel P. Next, the lever 30 is temporarily maintained in a specified fitting starting position (see FIG. 3) while the female connector housing 20 is fitted into the hood member 13. Then, the cam pins 19 are fitted into the receiving holes 33A of the cam grooves 33 (see FIG. 4). In this state the lever 30 is rotated and the fitting together of the cam campins 19 and the cam grooves 33 draws the female connector housing 20 into the hood member 13. When the lever 30 reaches the fitting completion position, the connector housings achieve a correctly fitted state (see FIG. 5).

In this state, the fitting sealing member 27 fits tightly, and in a waterproof manner, with the far end face of the hood member 13 and prevents water from outside from entering the connector housings 10 and 20 from the space between the two housings. Furthermore, the receiving members 34 of the female connector housing 20 fit with the left face of the panel P, and the attachment hole sealing member 16 fits tightly, and in a waterproof manner, with the right face of the panel P (see FIG. 7). As a result, water is prevented from entering through the space between the attachment hole H and the hood member 13.

If, from this fitted position, the lever 30 is rotated in the opposite direction to that mentioned above, the mutual fitting of the cam grooves 33 and the cam pins 19 separates the connector housings 10 and 20. If the lever 30 is returned to the fitting starting position, the cam floor members come to be located in the receiving holes 33A of the cam grooves 33 and, consequently, the connector housings 10 and 20 can be separated from this state if they are pulled apart by hand.

As mentioned above, the fitting means of the connector housings 10 and 20 in the present embodiment is the mutual fitting of the cam pins 19 provided in the male connector housing 10 and the cam grooves 33 of the levers 30 provided in the female connector housing 20. Consequently, a bolt is not required. Furthermore, the cam function means 29, comprising the cam pins 19 and the lever 30, is provided between the fitting sealing member 27 and the attachment hole sealing member 16. Consequently, its function does not hinder the waterproofing function of these two sealing members 16 and 27.

Moreover, in the present embodiment, the attachment hole sealing member 16 is attached tightly and reliably to the panel P through the fitting together of the receiving members 34 with the panel P and, as a result, the reliability of the waterproofing function is improved.

Next, the second embodiment of the present invention is explained below with the aid of FIGS. 8 to 12.

In the first embodiment described above, the lever 30 is supported on the female connector housing 20 and the cam pins 19 are formed on the male connector housing 10. In contrast, the second embodiment has a configuration whereby a lever 40 is supported on a male connector housing 10 and cam pins 41 are formed on a female connector housing 20. As a result, the configuration of a hood member 42, a grommet cover 43 and the lever 40 differ from that of the first embodiment.

These differences in configuration are described below.

A pair of lever housing chambers 45 are provided in a separating wall 44 formed along left and right inner side faces of the hood member 42, these lever housing chambers 45 housing arm members 46 of the lever 40. A pair of supporting holes 47 are formed on the side walls of the hood member 42, supporting axles 48 protruding outwards from the arm members 46 fitted therein. As a result, an operating member 49 of the lever 40 can be rotated between a fitting starting position; a position located at the upper edge of the hood member 42, whereby the hood member 42 is opened wide (see FIGS. 10 and 11), and a fitting completion position in which the operating member 49 is located at the lower edge of the hood member 42 (see FIG. 12). Moreover, a pair of cam pins 41 protrude from left and right external side faces of the grommet cover 43, these cam pins 41 fitting with cam grooves 50 of the lever 40. The lever 40 mentioned above and the cam pins 41 comprise a cam function means 51.

When the connector housings 10 and 20 are to be fitted together, the male connector housing 10 is attached to the attachment hole H of the panel P and the lever 40 is temporarily maintained in the fitting starting position (see FIG. 10) while the female connector housing 20 is fitted into the hood member 42. Then, the cam pins 41 are fitted into receiving holes 50A of the cam grooves 50. In this state the lever 40 is rotated and the fitting together of the cam pins 41 and the cam grooves 50 draws the female connector housing 20 into the hood member 42. When the lever 40 reaches the fitting completion position, the connector housings achieve a correctly fitted state (see FIG. 12).

In this state, as in the first embodiment P, the fitting sealing member 27 prevents water from entering housing main bodies 11 and 23 from the space between the connector housings 10 and 20, and the fitting sealing member 27 prevents water from entering through the space between an attachment hole H and the hood member 42.

As stated above, in the present embodiment, the fitting means of the connector housings 10 and 20 is the mutual fitting of the cam pins 41 provided in the female connector housing 20 and the cam grooves 50 of the lever 40 provided in the male connector housing 10. Consequently, a bolt is not required.

Furthermore, the cam function means 51 comprising the cam pins 41 and the lever 40 are provided within the range of the fitting sealing member 27 and the attachment hole sealing member 16 and consequently their function does not hinder the waterproofing function of these two sealing members 16 and 27.

Moreover, in the present embodiment, the attachment hole sealing member 16 is attached tightly and reliably to the panel P through the fitting together of the receiving members 34 with the panel P and as a result the reliability of the waterproofing function is improved.

Furthermore, the present invention is not limited to the embodiments described above with the aid of figures. For example, the possibilities described below also lie within the technical range of the present invention. In addition, the present invention may be embodied in various other ways without deviating from the scope thereof.

(1) A configuration is possible in which the male connector housing is fixed separately and immovably to the panel, the female connector housing being without receiving member.

(2) The fitting sealing means may equally well be provided on the male connector housing.

(3) In the second embodiment the cam floor members protrude from the inner peripheral face of the hood member. However, according to the present invention, the cam floor members may equally well protrude from the outer peripheral face of the hood member.

(4) The attachment hole sealing means may equally well be provided on the female connector housing, and the receiving members may be provided on the male connector housing.

What is claimed is:

1. A panel mount electrical connector comprising:

a first connector housing having a first terminal therein, a clamp to secure the first connector housing in an aperture of a panel, and a hood with a pair of opposite pins therein;

a second connector housing having a second terminal therein to couple with the first terminal;

an elastomeric grommet having a socket receiving the second connector housing; and a cover having a socket receiving the grommet and the second connector housing, and a lever with a pair of cam grooves engaging the pins to move the two connector housings toward and away from each other;

the second connector housing, the grommet and the cover being received through the panel and into the hood of the first connector housing with the grommet extending to engage and seal both connector housings.

2. The panel mount connector as claimed in claim 1 wherein the first connector housing includes a seal member which engages the panel about the aperture to form a first seal between the first connector housing and the panel.

3. The panel mount connector as claimed in claim 2 wherein the first connector housing and the cover each include an abutment to engage opposite sides of the panel.

4. The panel mount connector as claimed in claim 2 wherein the seal member of the first connector housing is mounted in a groove in the abutment of the first connector housing.

5. The panel mount connector as claimed in claim 4 wherein the abutment of the cover is generally aligned with the seal member of the first connector housing.

6. A panel mount electrical connector comprising:

a first connector including a housing having a first terminal therein and a hood with a pair of opposite pins therein, a clamp to secure the first connector housing in an aperture of a panel, and a first seal member which engages the panel about the aperture to form a first seal between the first connector and the panel; and a second connector including a housing having a second terminal therein to couple with the first terminal, a second seal member at a front end of the second connector, and a lever with a pair of cam grooves engaging the pins to move the two connectors toward and away from each other;

wherein the second connector is received through the panel and into the hood of the first connector housing with the second seal engaging both connector housings and forming a second seal therebetween, and wherein the interaction of the pins and the cam grooves is positioned between the first and second seals.

7. The panel mount connector as claimed in claim 6 wherein each of the connectors include an abutment to engage opposite sides of the panel.

8. The panel mount connector as claimed in claim 7 further comprising a flat clamping surface on each connector housing to abut and securely grip the panel therebetween.

9. The panel mount connector as claimed in claim 7 wherein the first sealing member is aligned with the abutment of said second connector.

10. The panel mount connector as claimed in claim 9 wherein an abutment is provided on opposite sides of said second connector.

11. The panel mount connector according to claim 7 wherein the abutment of the first connector abuts said first sealing member and comprises a substantially continuous shoulder.

12. The panel mount connector as claimed in claim 11 wherein the shoulder has a lip to retain the first sealing member.

13. The panel mount connector as claimed in claim 12 wherein the lip is substantially continuous.

14. The panel mount connector as claimed in claim 7 wherein the clamp includes a snap fit projection engageable with an edge of the aperture.

15. The panel mount connector as claimed in claim 14 wherein the snap fit projection disengages the edge of the aperture as the housings are drawn together by said lever clamp, in use.

16. The panel mount connector as claimed in claim 14 wherein the snap fit projection is received in a recess of the second connector, in use.

17. The panel mount connector as claimed in claim 16 wherein the recess is provided in the abutment of the second connects.

18. The panel mount connector as claimed in claim 15 wherein the snap fit projection is received in a recess of the female connector housing, in use.

19. The panel mount connector as claimed in claim 18 wherein the recess is provided in the abutment of the second connects.

* * * * *